United States Patent [19]

Du et al.

[11] Patent Number: 4,972,756

[45] Date of Patent: Nov. 27, 1990

[54] BRAIDING MACHINE HAVING SELF-PROPELLED BOBBIN CARRIERS

[75] Inventors: Guang-Wu Du, Newark, Del.; Timothy D. Kostar, Yardley, Pa.

[73] Assignee: University of Delaware, Newark, Del.

[21] Appl. No.: 366,112

[22] Filed: Jun. 14, 1989

[51] Int. Cl.[5] ..... D04C 3/14; D04C 3/16; B65H 59/10; B65H 77/00

[52] U.S. Cl. ..... 87/56; 87/33; 87/50; 87/55; 87/61; 242/155 R

[58] Field of Search ..... 87/5, 6, 7, 8, 54–56, 87/28–30, 33, 44, 50, 51, 61; 242/153, 154, 155 R

[56] References Cited

U.S. PATENT DOCUMENTS 3,981,223 9/1976 Ostermann ..... 87/50
4,304,169 12/1981 Cimprich et al. ..... 87/29
4,719,837 1/1988 McConnell et al. ..... 87/1

FOREIGN PATENT DOCUMENTS 150182 12/1976 Netherlands .

OTHER PUBLICATIONS

Fiber Tex '88 Conference, Greenville, S.C., Sep. 13–15, 1988; Analysis and Automation of Two-Step Braiding.

*Primary Examiner*—John Petrakes
*Attorney, Agent, or Firm*—Dean R. Rexford

[57] ABSTRACT

A simple braiding machine readily adaptable to a variety of braiding tasks comprises self-propelled bobbin carriers guided by a track consisting of interchangeable units similar to the interchangeable track units of a toy train. Also disclosed is a simple yarn tensioner capable of maintaining constant tension in the braiding yarn and capable of taking up slack yarn.

2 Claims, 4 Drawing Sheets

BRAIDING MACHINE HAVING SELF-PROPELLED BOBBIN CARRIERS

BACKGROUND OF THE INVENTION

1. Field of the Invention

The invention is in the field of machines for producing braided structures useful inter alia as reinforcements for composites.

2. Description of the Related Art

The braiding process is one of the traditional methods of interconnecting strands of fibers into fabrics, ropes and tubes.

In the braiding process, yarns are normally fed through a machine where they are caused to interlace with each other to form various braided structures. Such structures, following their early use in the reinforcement of hoses such as fire hoses, have become increasingly important in the reinforcement of so-called composite structures of various shapes and uses.

The usual braiding machine interlaces yarns as follows. Braiding yarns, wound on bobbins, are carried on a carrier which is said to 'float' with respect to the rest of the machine because they are not permanently attached to the rest of the machine. Typically a plurality of carriers move in intersecting paths in the braiding plane, generally half in each direction. The result is that the 'free' ends of the yarns are interlaced over and under other yarns at the braid formation point The carriers are generally propelled in guiding slots by means of notched disks called 'horn gears'. Rotating close together in opposite directions, the gears pass the carriers from one gear to another. Such a system is shown, for example, in U.S. Pat. No. 3,981,223.

The carriers usually move in a roughly horizontal plane, usually called the braiding plane. The point at which the braid is assembled, called the braiding point, lies above the plane.

However, it is not necessary to the functioning of the braider that the braiding plane be horizontal and that the braiding point be above the plane. U.S. Pat. No. 4,304,169 shows a braiding machine wherein a series of alternate braiding planes and braiding points are arranged in a horizontal configuration. The invention of this application can be applied to any single or series arrangement regardless of the orientation of the device.

The term 'yarn' as used herein is intended to comprise all forms of yarn, synthetic or natural, organic or metallic of any cross section.

Naturally, as in most active arts, many variations are known and practiced. For example, it is common practice to enclose so-called axial yarns in braided structures. Axial yarns are yarns which are simply fed into the braided structure without themselves being interlaced about other yarns; they are held in place by yarns which are interlaced as described above.

Since the bobbins move with respect to the braiding point, means are usually needed to maintain approximately constant tension in the yarn leaving the bobbin and to take up yarn when the bobbin moves in the direction of the braiding point. This is variously accomplished, e.g. by providing a spring loaded idler wheel to each yarn combined with a pawl to prevent excessive unwinding from the bobbin.

Common to most commercial braiders is a high degree of mechanical complexity and specialization such that a particular machine is often capable of producing only a single braiding design without extensive modification.

SUMMARY OF THE INVENTION

It is an object of this invention to provide a simple braiding machine capable of easy conversion from one task to another.

More specifically this invention is directed to a braiding machine comprising one or more bobbin carriers moving along a braiding path in the braiding plane, wherein the improvement comprises bobbin carriers which are self-propelled; and the further improvement that said braiding path or track consists of interchangeable units comprising guidance slots and means for delivering electric power to the self-propelled carriers, said units providing cross-overs and curves to the track.

A still further improvement is provided in a yarn tensioner comprising:

(a) A bracket having an essentially straight slot comprising a first end and a second end, said slot surrounding a first axle, said first axle being free to move in said slot in an essentially straight line essentially at right angles to the principal axis of said first axle;

(b) a spring urging said axle toward said first end;

(c) a yarn bobbin and a first pulley mounted coaxially on said first axle;

(d) a drive belt engaging said first pulley and a second pulley lying on an essentially straight line extension from the second end of said slot;

(e) said second pulley being in mechanical communication with a motor normally turning in a direction to roll up yarn on said bobbin;

(f) means for directing yarn onto said bobbin from the direction of the second end of said slot whereby tension in said yarn urges said first axle in a direction opposed to the urging of said spring whereby to reduce tension in and cause slippage in said drive belt.

DESCRIPTION OF THE PREFERRED EMBODIMENTS

As is further elaborated in the description following the term "self-propelled" as applied to bobbin carriers is intended to mean that energy such as electrical energy initiates mechanical movement in the carrier itself, as opposed to the case in art devices wherein energy, alreadY in the form of mechanical energy is transferred to the bobbin carrier, for example, by a horn gear.

Figure 1:
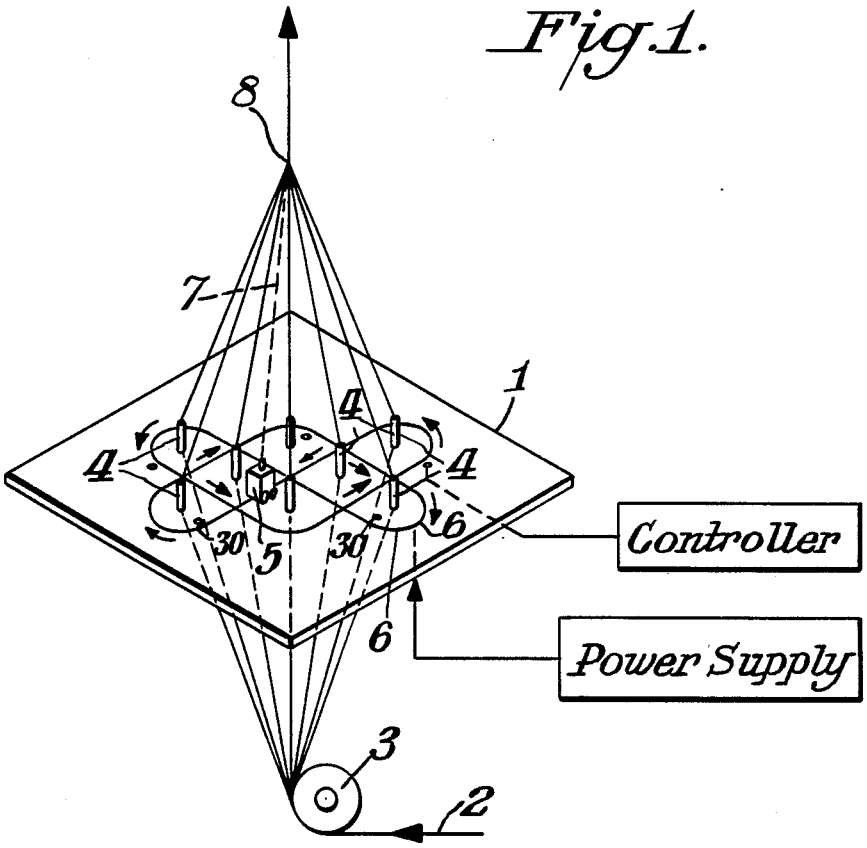
FIG. 1 is a schematic, isometric drawing showing a single bobbin embodiment of the invention.

Turning now to FIG. 1, one sees a schematic, isometric drawing of a single bobbin embodiment of the invention. Entering the braiding plane 1 are axial yarns 2 originating at a source outside the invention device. Axial yarns 2 pass over a roller 3 after which they are distributed to short pipe-like guides 4 which guide the axial yarns for a sufficient distance above braiding plane 1 that bobbin carrier 5, comprising a braiding yarn bobbin and an electric drive motor, can follow path 6 without interference. Braiding yarn 7, shown as a broken line, as a result of the course taken by carrier 5, interlaces with axial yarns at braiding point 8. Pins at stop point 30, controlled by the controller shown, engage, when raised, a micro switch 31 on bobbin carrier 5 thus stopping the carrier. These arrangements are not strictly necessary in the single bobbin carrier embodiment of this figure. They are necessary in multi-bobbin carrier embodiments because carriers do not always complete their rounds at the same time. For this reason, all carriers are stopped by these means after completing their rounds to give the slower carriers time to catch up.

Figure 2:
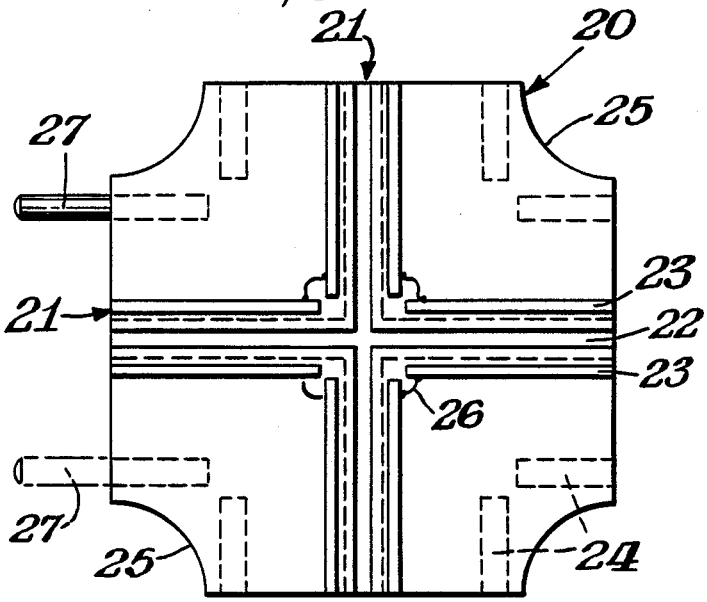
FIG. 2 shows a crossover track unit of the invention, hereinafter called a tile.

FIG. 2 shows crossover 20 comprising track 21, the track in this embodiment consisting of slot 22 and electrical conductor strips 23. Dowel pin holes 24 provide for dowels 27 to hold the tiles together. Cut-out sections 25 provide space for guides 4. Wires 26 provide electrical connection to electrical conductor strips 23. Electricity supply is provided from underneath by connections not shown.

Figure 3:
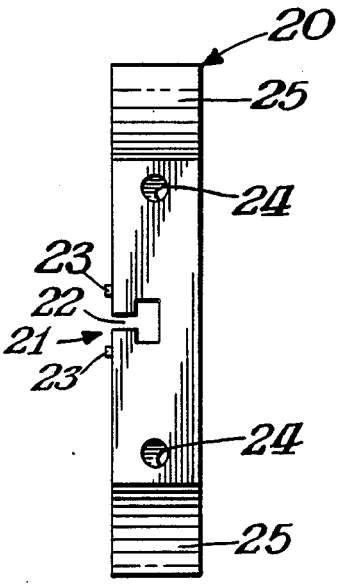
FIG. 3 is a side view of FIG. 2.

FIG. 3 shows a view from one side of FIG. 2.

Figure 5:
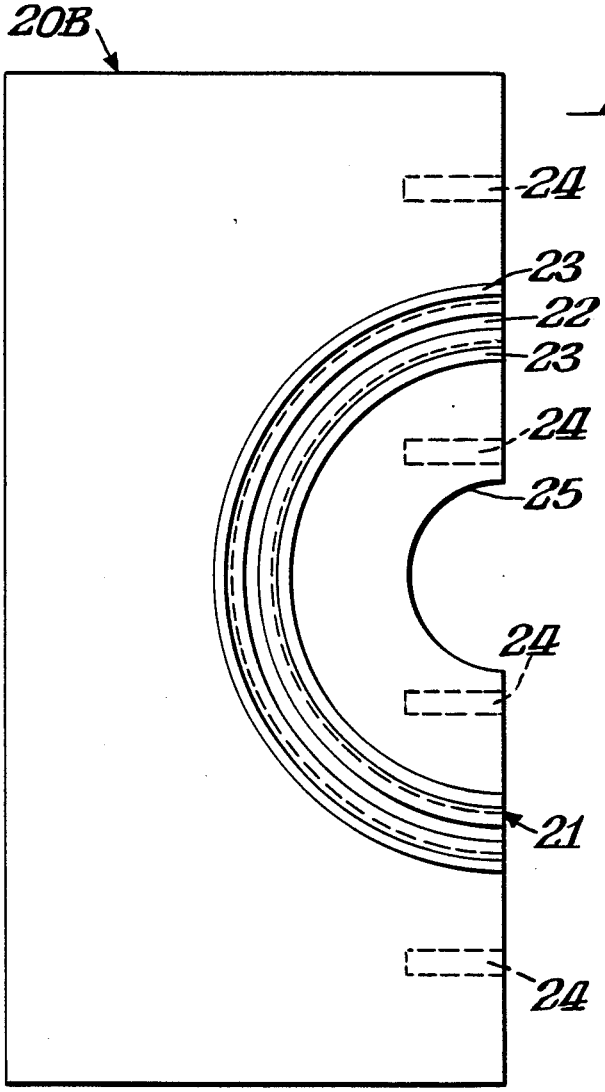
FIG. 5 shows a 180 degree tile of the invention.
Figure 4:
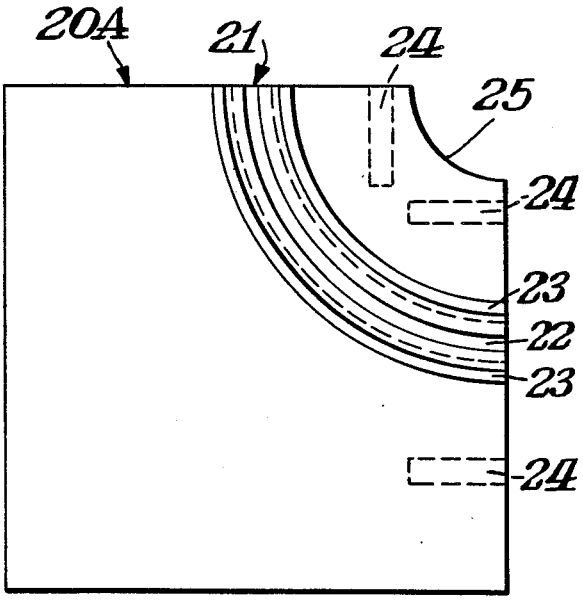
FIG. 4 shows a 90 degree curve tile of the invention.

FIG. 4 shows a 90 deg curve tile 20A and FIG. 5 shows a 180 deg curve tile 20B. It is preferred, although not necessary, to employ a single 180 deg tile as opposed to using two 90 deg tiles. The component numbers correspond to those of FIG. 2.

Figure 6:
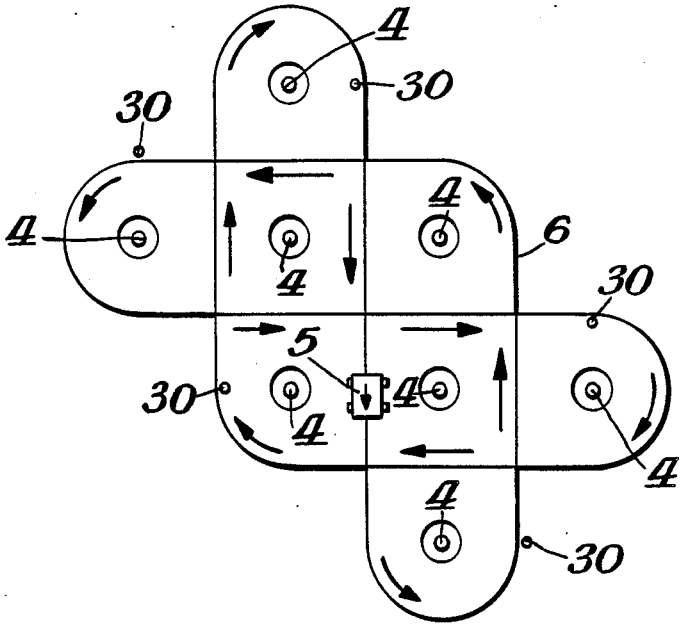
FIG. 6 is a schematic drawing showing the course of a simple braiding path about axial yarn guides.

FIG. 6 shows the course of a simple track 6 passing between guides 4. Stop points 30 are controller- or timer-actuated pins which rise to engage micro switches 31 (see FIG. 8) on carriers 5 so as to cause them to pause until all cars have completed their rounds, normally two cycles. The track of FIG. 6 is capable of operation with a single carrier, although a plurality can be employed.

Figure 7:
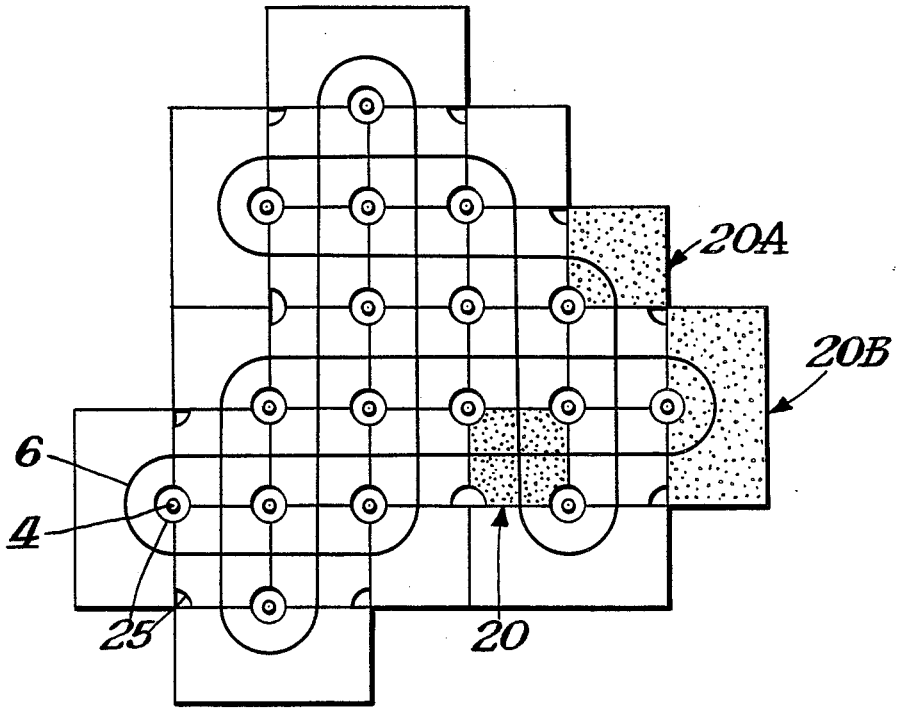
FIG. 7 shows a more complex track produced by the same three kinds of tiles. Invention devices having the braiding path arrangement of FIGS. 6 and 7 produce two-step braids as described, for example, in U.S. Pat. No. 4,719,837. The path of FIG. 7 produces a T-beam composite structure reinforcement.

FIG. 7 shows a more complex track requiring at least two carriers. This drawing shows the manner in which tiles of the invention are assembled. For simplicity, stop points are not shown. Representatives of each of the three preferred kinds of tiles are set out with stippling add identified. The track produces a two-step braided T-beam reinforcement.

Figure 8:
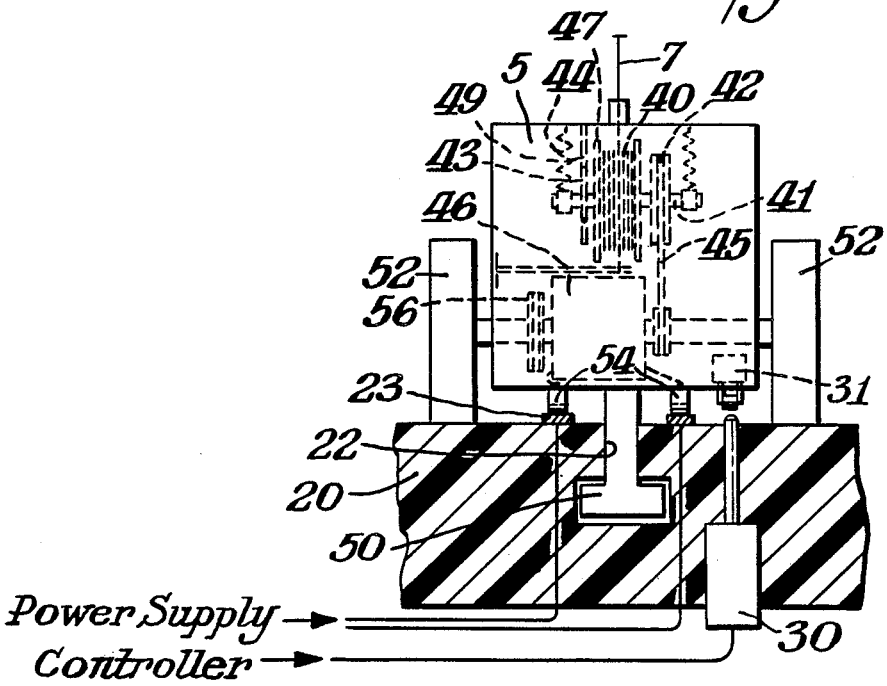
FIGS. 8 and 9 show a simple tensioner capable of maintaining constant tension and of taking up slack yarn.

FIG. 8 shows a yarn bobbin and tensioner assembly carried in carrier 5. The assembly is capable not only of providing constant tension but also of taking up slack yarn when, for example, the vector distance between the travelling bobbin and the braiding point decreases, e.g., when the carrier moves toward the center of the braiding plane. As is seen in the figure, bobbin 40 carrying yarn and supported on axle 41, comprises an integral belt-engaging surface 42. Axle 41 and bobbin 40 are urged upward in slot 43 by spring 44 which is in tension and adjustable by means not shown. The upward urge exerted bY spring 44 is opposed by belt 45, forces exerted by the braiding operation on yarn 7 (see FIG. 9), and, of course, the weight of the device. When the pull exerted on the yarn by the braiding operation increases, the downward pull on the bobbin causes decreased tension on belt 45 thus allowing the belt to slip somewhat thus reducing thereby the tendency of motor 46 to resist the pull-off of yarn from bobbin 40. When, however, the tension is reduced, e.g. the yarn becomes slack, the bobbin rises and tension on belt 40 is increased, thereby transferring turning force to bobbin 40 and rolling up slack yarn.

Component 47 is a flange which confines yarn to bobbin 40. Metal bracket 49 contains slot 43. T-shaped member 50 prevents carrier 5 from leaving track 23. Wheels 52 are connected to drive motor 46 by means of belted wheel 56.

Figure 9:
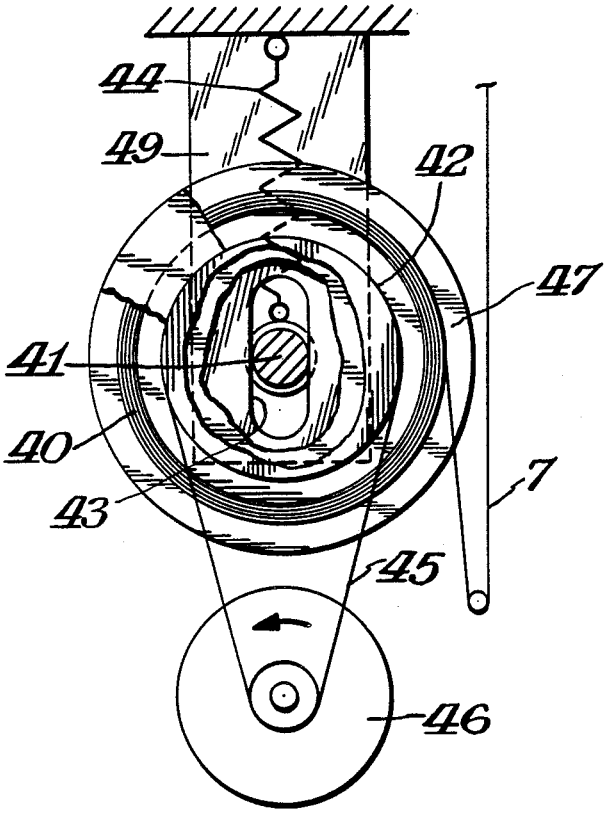

FIG. 9 shows a partially cut away end view of the tensioner assembly.

The materials of construction are a matter of choice for the skilled artisan. It is convenient to employ poly(-methylmethacrylate) for the construction of the tiles, although other materials such as aluminum or steel can also be used, provided that insulation measures are taken, as will be evident to the artisan. Slots 22 are fabricated with an undercut to accomodate a T-shaped member 50 attached to carrier 5 to prevent carrier 5 from leaving the track. If it is expected that long runs will be undertaken, it is preferred to employ a T-shaped member comprising two wheels, preferably with roller or ball bearings, to engage the top surfaces of the undercut. The electrical conductor strips 23 are preferably fabricated from copper although other metals of good conductivity are operable. The conductors are attached to the tile by conventional means such as riveting or adhesion. The conductors bring electric power from a convenient source outside this invention, to the carrier 5 drive motor and optionally a second motor dedicated to regulating yarn tension, one or both being contained in carrier 5. It is preferred to employ a single drive motor and that this motor be employed both to drive the wheels of the carrier and to maintain yarn tension as shown in FIGS. 8 and 9 and in the above description. The electric current is carried from the electrical conductor strips to the carrier and motor(s) by means of a brushes 54. Other means may be employed, e.g., unshod wheels may be so arranged as to carry out this task. The drive wheels may be simple rubber-shod wheels which engage the flat surface of the tile, or cog wheels may be employed to engage cogs in the tile, not shown.

Having now disclosed our invention, we claim:

1. In a braiding machine comprising one or more self-propelled bobbin carriers moving in a braiding path in a braiding plane whereby to direct yarn between said carriers and the braiding point the improvement wherein said braiding machine further comprises a yarn tensioner carried in said carriers for regulating the tension of said yarn between said carriers and said braiding point, said tensioner comprising:

(a) A bracket having an essentially straight-line slot comprising a first end and a second end, said slot surrounding a first axle, said first axle being free to move in said slot in an essentially straight line essentially at right angles to the principal axis of said first axle;

(b) a spring urging said axle toward said first end;

(c) a yarn bobbin and a first pulley mounted coaxially on said first axle;

(d) a drive belt engaging said first pulley and a second pulley lying on an essentially straight line extension from the second end of said slot;

(e) said second pulley being mechanically connected to a motor propelling said carriers and normally turning in a direction to roll up yarn on said bobbin;

(f) means for directing yarn onto said bobbin from the direction of the second end of said slot whereby tension in said yarn urges said first axle in a direction opposed to the urging of said spring whereby to reduce tension in and cause slippage in said drive belt.

2. In a braiding machine comprising one or more bobbin carriers moving in a braiding path in a braiding plane wherein said bobbin carriers are self-propelled, the improvement wherein said path consists of interchangeable units comprising guidance slots and means for delivering power to said self-propelled carrier, said units being in the form of cross-overs and curves, said braiding machine comprising a yarn tensioner carried in said carriers for regulating the tension of yarn between said carriers and the braiding point, said tensioner comprising:

(a) A bracket having an essentially straight-line slot comprising a first end and a second end, said slot surrounding a first axle, said first axle being free to move in said slot in an essentially straight line essentially at right angles to the principal axis of said first axle;

(b) a spring urging said axle toward said first end;

(c) a yarn bobbin and a first pulley mounted coaxially on said first axle;

(d) a drive belt engaging said first pulley and a second pulley lying on an essentially straight line extension from the second end of said slot;

(e) said second pulley being mechanically connected to a motor propelling said carriers and normally turning in a direction to roll up yarn on said bobbin;

(f) means for directing yarn onto said bobbin from the direction of the second end of said slot whereby tension in said yarn urges said first axle in a direction opposed to the urging of said spring whereby to reduce tension in and cause slippage in said drive belt.

* * * * *